US005385619A

United States Patent [19]

Downes et al.

[11] Patent Number: 5,385,619

[45] Date of Patent: Jan. 31, 1995

[54] NITROCELLULOSE PROPELLANT COMPOSITION

[75] Inventors: Thomas B. Downes; Ian A. Duncan, both of Ayrshire, Scotland

[73] Assignee: Royal Ordnance PLC, Lancashire, England

[21] Appl. No.: 163,121

[22] Filed: Jan. 5, 1988

Related U.S. Application Data

[63] Continuation of Ser. No. 754,901, Apr. 12, 1985, abandoned.

[30] Foreign Application Priority Data

Apr. 16, 1984 [GB] United Kingdom ..... 8409867

[51] Int. Cl.[6] ..... C06B 45/10; C06B 25/18

[52] U.S. Cl. ..... 149/19.4; 149/19.8; 149/96; 149/98; 149/100

[58] Field of Search ..... 149/19.8, 96, 98, 100, 149/19.4

[56] References Cited

U.S. PATENT DOCUMENTS

| | | | |
|---|---|---|---|
| 3,960,621 | 6/1976 | Whitworth et al. | 149/98 |
| 4,000,025 | 12/1976 | Johnson et al. | 149/19.8 |
| 4,025,370 | 5/1977 | Csanady et al. | 149/100 |
| 4,226,792 | 10/1980 | Tajima | 149/98 |
| 4,234,444 | 1/1981 | Alley et al. | 149/98 |
| 4,239,561 | 12/1980 | Cane et al. | 149/19.8 |
| 4,408,534 | 10/1983 | Araki et al. | 149/19.8 |
| 4,416,712 | 11/1983 | Mönch | 149/98 |
| 4,521,261 | 6/1985 | Davies | 149/19.8 |

FOREIGN PATENT DOCUMENTS 1500685 2/1978 United Kingdom .

*Primary Examiner*—Edward A. Miller

*Attorney, Agent, or Firm*—Cushman, Darby & Cushman

[57] ABSTRACT

Nitrocellulose propellant compositions are provided comprising as ballistic modifier a copper II complex of a $C_6$-$C_{12}$ chain aliphatic carboxylic acid, advantageously in conjunction with one or more conventional ballistic modifiers for example, lead or copper compounds such as lead stearate, lead acetophthalate, lead $\beta$-resorcylate and basic copper salicylate. The preferred complex is copper II caproate. The propellant compositions exhibit good quality plateau or mesa burning over a useful pressure range for a wide range of energy and burning rates. The copper II complexes are especially advantageous in cast double base propellants particularly because their solubility in the organic solvents used facilitates their incorporation into these compositions.

9 Claims, 9 Drawing Sheets

NITROCELLULOSE PROPELLANT COMPOSITION

This is a continuation of application Ser. No. 06/754,901, filed Apr. 12, 1985, now abandoned.

This invention relates to nitrocellulose (NC) based propellant composition containing ballistic modifier to produce the effect of plateau or mesa burning over significant ranges of pressure.

BACKGROUND OF THE INVENTION

In general for a given ignition temperature the burning rate of a propellant is related to the pressure to which it is exposed in a manner which can be expressed mathematically by the expression $$r=kp^n$$

Where r is the burning rate, p is the pressure and k and an are constants which are characteristic of the propellant. Thus r increases exponentially with increasing p and log r increases linearly with log p, the graph of log r against log p being a line of slope n. In conventional propellant without ballistic modifier, the pressure exponent n has a value of 0.5 to 0.8 and for rocket propulsion the progressive increase in burning rate with increasing pressure presents problems in designing motors to withstand the pressures which could be developed. In order to overcome this problem NC based propellant compositions containing ballistic modifiers have been developed, the modifier being effective to modify the burning rate and pressure relationship so that over a useful working pressure range the pressure exponent n is reduced. In the region where n=o the graph of log r against log p contains a flat portion, termed a 'plateau' and the burning is termed 'plateau burning'. In some cases n is reduced to a negative value over a certain pressure range, such propellant burning being termed 'mesa burning'. Ballistic modifiers causing a reduction of the pressure exponent are termed platonisation agents. Plateau burning propellants give reduced motor performance variability in the region of the plateau and mesa burning provides additional safety against the development of high pressure in the propellant container.

Ballistic modifiers (platonisation agents) commonly used include organic salts such as lead salicylate, lead stearate or lead β-resorcylate and may also include additional metal salts such as copper salicylate, copper stearate or copper benzoate. The use of such ballistic modifiers is described for example, in U.S. Pat. Nos. 3,088,858, 3,923,564, United Kingdom Patent Specification 2121399 and Japanese Patent J55071690. For relatively fast burning propellants a favoured modifier comprises the reaction product of lead β-resorcylate and basic cupric salicylate as described in U.S. Pat. Nos. 3,989,776 and 4,001,287.

The currently used ballistic modifiers are deficient in some respects including, in some cases, difficulty of incorporation into propellant compositions, poor reproducibility of plateaux characteristics from batch to batch, adverse effect on long term stability, ballistic drift on storage and ineffectiveness in high energy composition. There is therefore an acute need for improved ballistic modified propellant composition, especially for well platonised fast burning high energy compositions containing, when necessary, aluminium or high levels of energetic fillers such as a nitramine, for example RDX (cyclo 1,3,5-trimethylene 2,4,6-trinitramine).

SUMMARY OF THE INVENTION

We have now discovered that NC based propellants having improved plateau or mesa burning characteristics may be obtained by using ballistic modifier comprising a copper II complex of a $C_6$–$C_{12}$ chain aliphatic carboxylic acid. These modifiers give good quality plateaux which are reproducible from batch to batch. They are soluble in the organic solvents used in the processing of cast double base propellants and can therefore be readily incorporated into these propellant compositions. The modified propellants are chemically stable and do not undergo ballistic drift on storage.

Thus in accordance with the invention an NC based propellant composition comprises, as ballistic modifier, at least one copper II complex of a $C_6$–$C_{12}$ chain aliphatic monocarboxylic acid. The aliphatic monocarboxylic acid may contain at least one branched or straight carbon chain but those containing a straight $C_6$–$C_{12}$ chain are generally preferred. The preferred branch chain complex is the copper II complex of 2-ethyl hexanoate acid and the preferred straight chain complexes include the copper II complexes of caproic acid, caprylic acid, capric acid and lauric acid. Cupric caproate is the most favoured in ballistic modifier for cast double base propellants because of its higher solubility in the processing solvents. These ballistic modifiers will, by themselves, give NC propellant compositions platonised over a useful pressure range for a wide range of burning rates, the modifiers being effective in most varieties of NC propellant including cast and extruded double base propellant containing nitroglycerine (NG) in addition to NC. However, we have found that ballistic modifier compositions comprising a mixture of the aforementioned copper complex and one or more of the lead or copper compounds effective as ballistic modifier permit the burning rate range and energy range of propellants to be extended. In particular, such mixtures facilitate the formulation of improved hgih burning rate and high specific impulse compositions. They are also effective to platonise NC propellants containing polymeric binder which were not satisfactorily platonised hitherto. Suitable lead and copper compounds for this purpose include lead stearate, lead citrate, lead phthalate, lead acetophthalate, lead salicylate, lead β-resorcylate, basic copper salicylate, copper β-resorcylate and copper oxide.

The propellant compositions of the invention preferably contain from 3 to 6.5% by weight of ballistic modifier and, when the modifier comprises a lead or copper compound acting as ballistic modifier in conjunction with the copper II complex of $C_6$–$C_{12}$ chain aliphatic monocarboxylic acid, the composition should preferably contain 1.7 to 5.0% by weight of the said copper II complex.

In addition to the nitrocellulose and ballistic modifier the propellants compositions of the invention may contain conventional propellant ingredients including NG (in double base propellant); stabilisers for example paranitro N-methylaniline, 2-nitrodiphenylamine or resorcinol; plasticisers, for example sucrose octoacetate, triacetin or dibutylphthalate; energetic constituents, for example a nitramine such as RDX or metal powder such as aluminium; burning rate moderants, for example carbon black; lubricants, for example candelilla wax; polymeric binders for example polycaprolactone crosslinked with isocyanate; and flash suppressants, for example potassium nitrate.

Platonised propellant compositions of the invention may vary over wide ranges of energy and burning rates. Thus useful composition may be formulated covering the energy range from about 800 calories/gm to 1200 calories/gm and burning rates from about 4 mm/sec to about 45 mm/sec. The composition may be prepared by the conventional propellant manufacturing methods as appropriate for the respective types of nitrocellulose propellant.

DETAILED DESCRIPTION

The invention is further illustrated by the following Examples wherein all percentages are given by weight.

The Examples were batches of propellant having the compositions shown in Table 1 prepared by standard propellant manufacturing methods using ingredients which, apart from the copper complexes used as ballistic modifier, were commonly used propellant constituents. The basic propellant manufacturing methods are described in chapter 17 of the book High Explosives and Propellants, by S Fordham 2nd Ed Pergamon Press 1980.

Examples 1, 3, 4 and 5 were cast double base propellants made by a standard method wherein a double base propellant powder containing most of the ingredients was prepared by a solvent incorporation method and subsequently mixed with a casting liquid containing about half of the nitroglycerine, all of the triacetin and part of the stabiliser. For testing the burning rates, slabs and end burning charges were cut from the cast propellant.

Example 2 was made by the solventless propellant process and Examples 6–9 inclusive were made by the solvent process. The propellant of these Examples was extruded into 2 mm diameter×18 cm long strands which were surface inhibited by treatment with vinyl lacquer to leave a constant burning end-surface. The burning rates of the strands were measured over a range of pressures when the strands were burned from the untreated end-surface in a Crawford Bomb strand burning apparatus under a nitrogen atmosphere.

EXAMPLE 1

Figure 1:
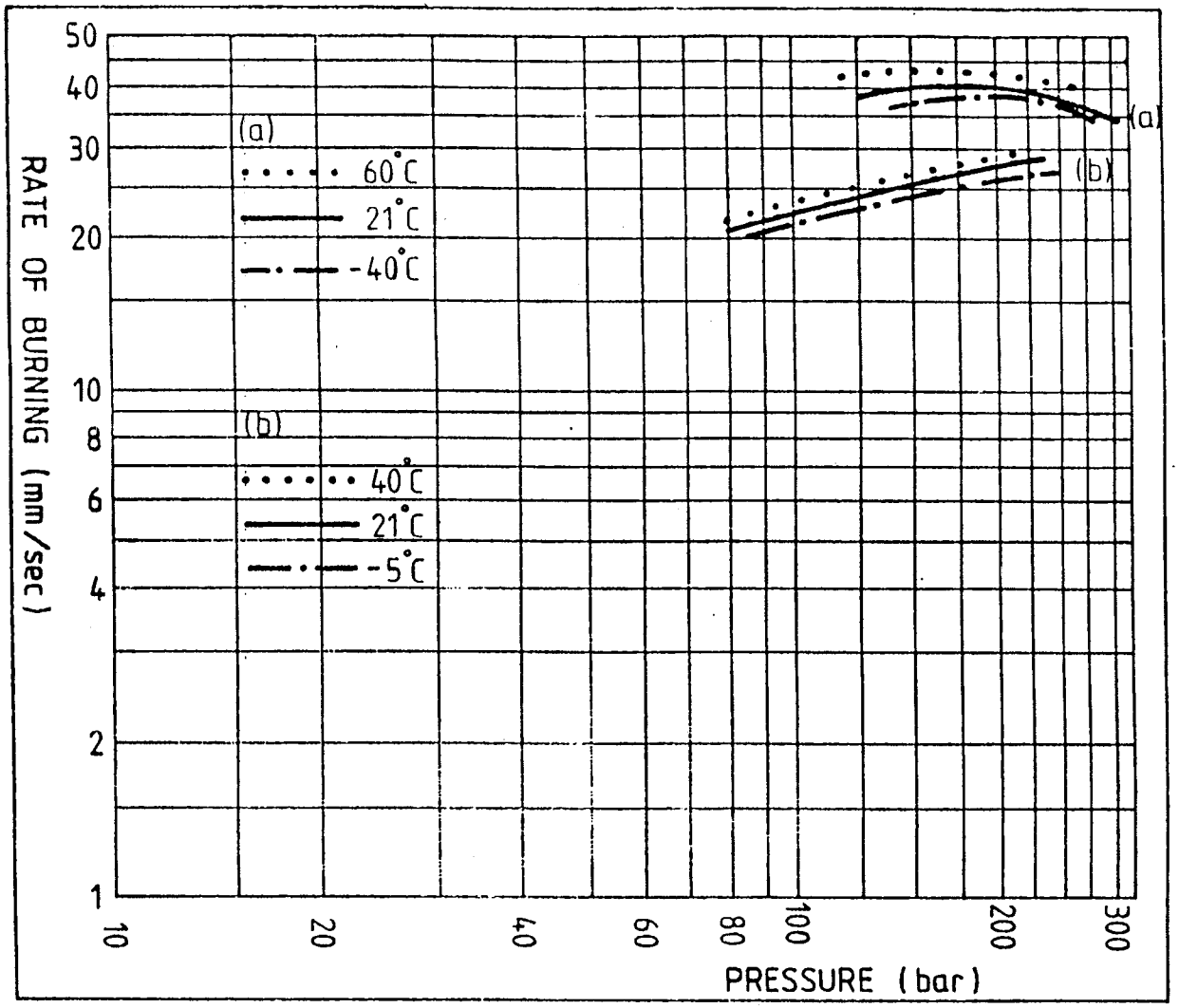
FIGS. 1–9 are graphs of burning rate versus pressure for the examples described hereinafter.

This Example was a platonised high burning rate cast double base propellant composition containing 2.0% of copper II caproate and 4.1% of lead β-resorcylate as ballistic modifier. The ballistic properties (burning rate v pressure) are shown graphically as the (a) curves in FIG. 1 and for comparison, the (b) curves in FIG. 1 denote the ballistic properties of an analagous composition without copper II caproate. The results indicate that the ballistic modifier substantially increased the burning rate to 45 mm/sec and gave plateau burning at a high pressure range of 150–300 bar. The burning rate did not vary much with the initial temperature (i.e. the temperature coefficient was low) over the range −40° to 60° C. in the plateau burning region.

EXAMPLE 2

Figure 2:
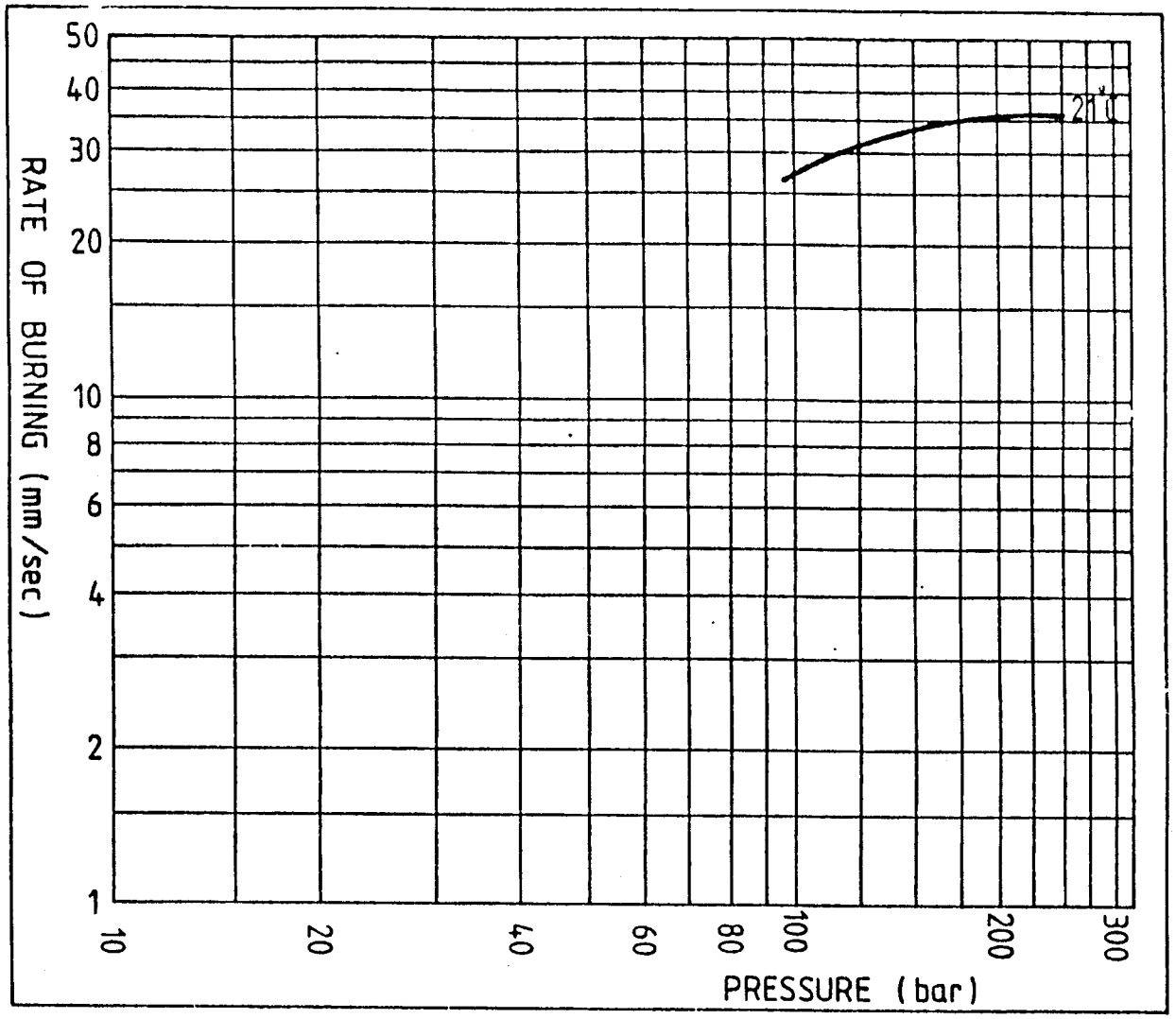

This Example was a platonised high burning rate solventless extruded double base propellant composition containing 2.0% of copper II caproate and 3.0% of lead β-resorcylate as ballistic modifier. The ballistic test results, of this composition shown graphically in FIG. 2, show that this composition exhibited plateau burning at a high burning rate of about 36 mm/sec over a pressure range of about 180–250 bar.

EXAMPLE 3

Figure 3:
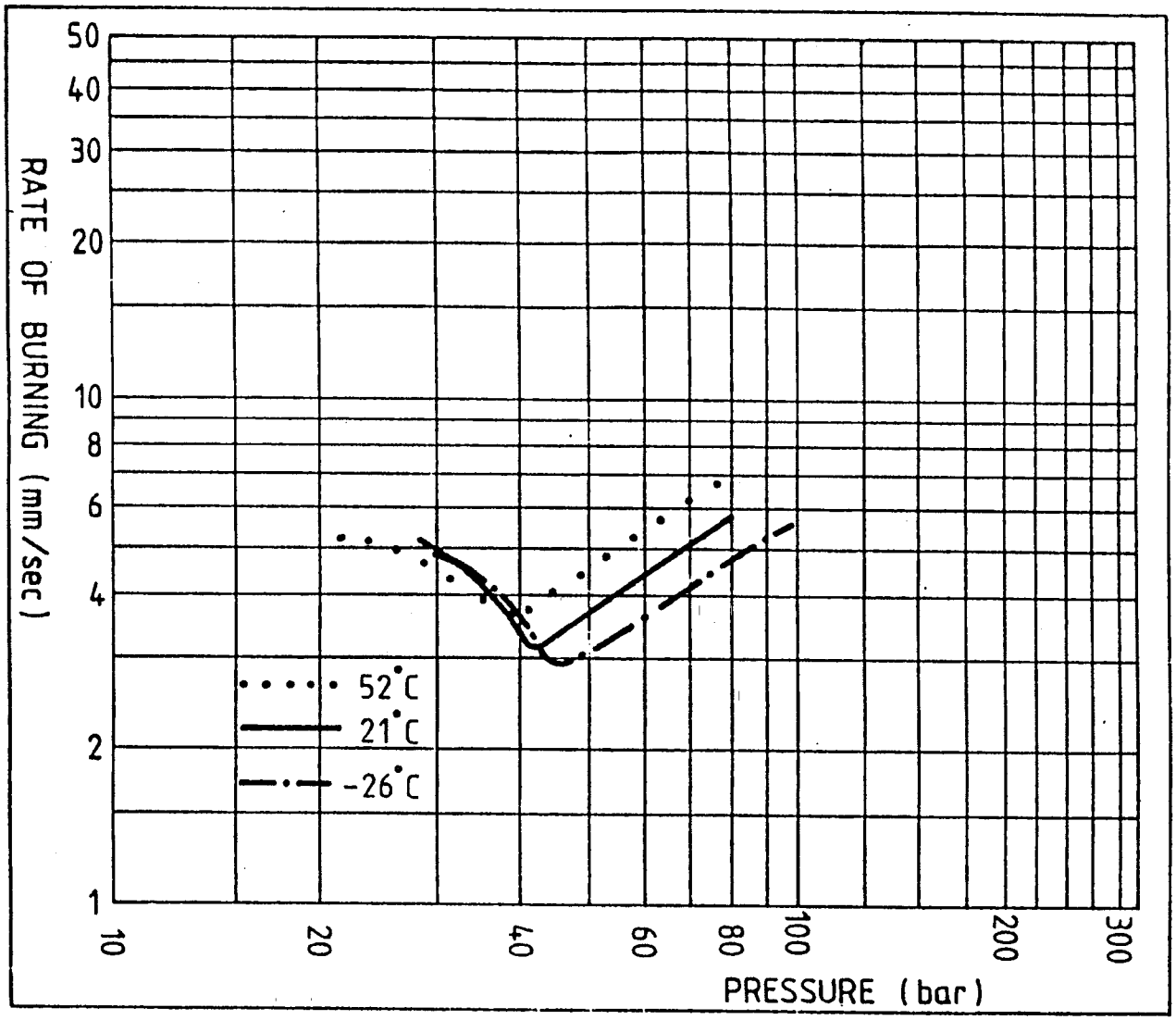

This Example was a platonised slow burning rate case double base propellant composition containing 1.7% of copper II caproate and 1.7% of lead acetophthalate as ballistic modifier. The ballistic test results of this composition are shown graphically in FIG. 3 for initial temperatures of −26° to 52° C. These results show that the effect of the modifier in this composition was to produce a slow burning rate mesa burning region over the pressure range of about 30–45 bar, with a satisfactory temperature coefficient over this pressure range.

EXAMPLE 4

Figure 4:
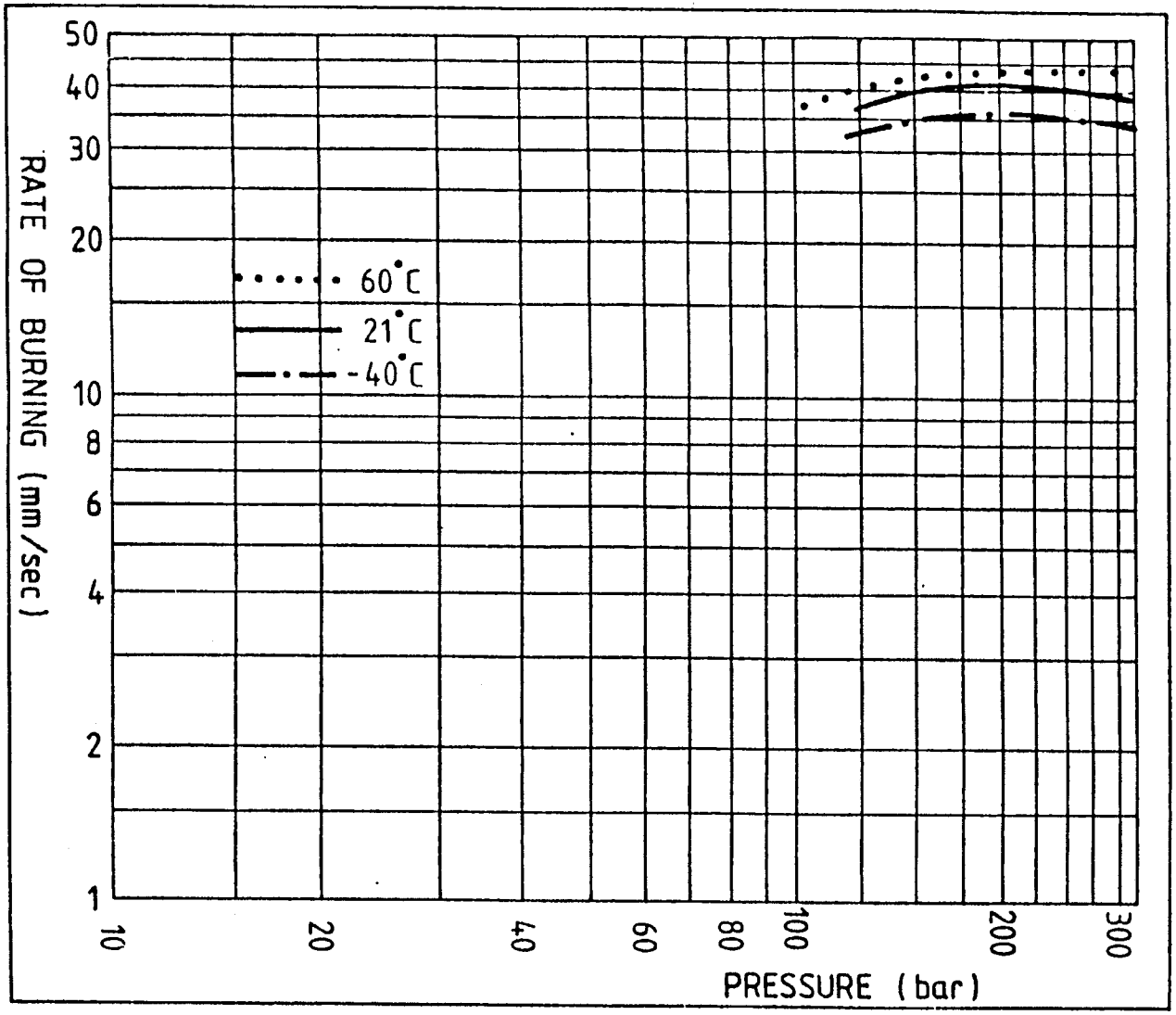

This Example was a platonised high burning rate high energy cast double base propellant composition containing 2.0% of copper II caproate and 4.1% of lead β-resorcylate as ballistic modifier and 4.6% aluminium as an energetic constituent. The ballistic test results, of this composition shown graphically in FIG. 4, indicate plateau burning at about 40 mm/sec over the pressure range of about 150–300 bar with satisfactory temperature coefficient.

EXAMPLE 5

Figure 5:
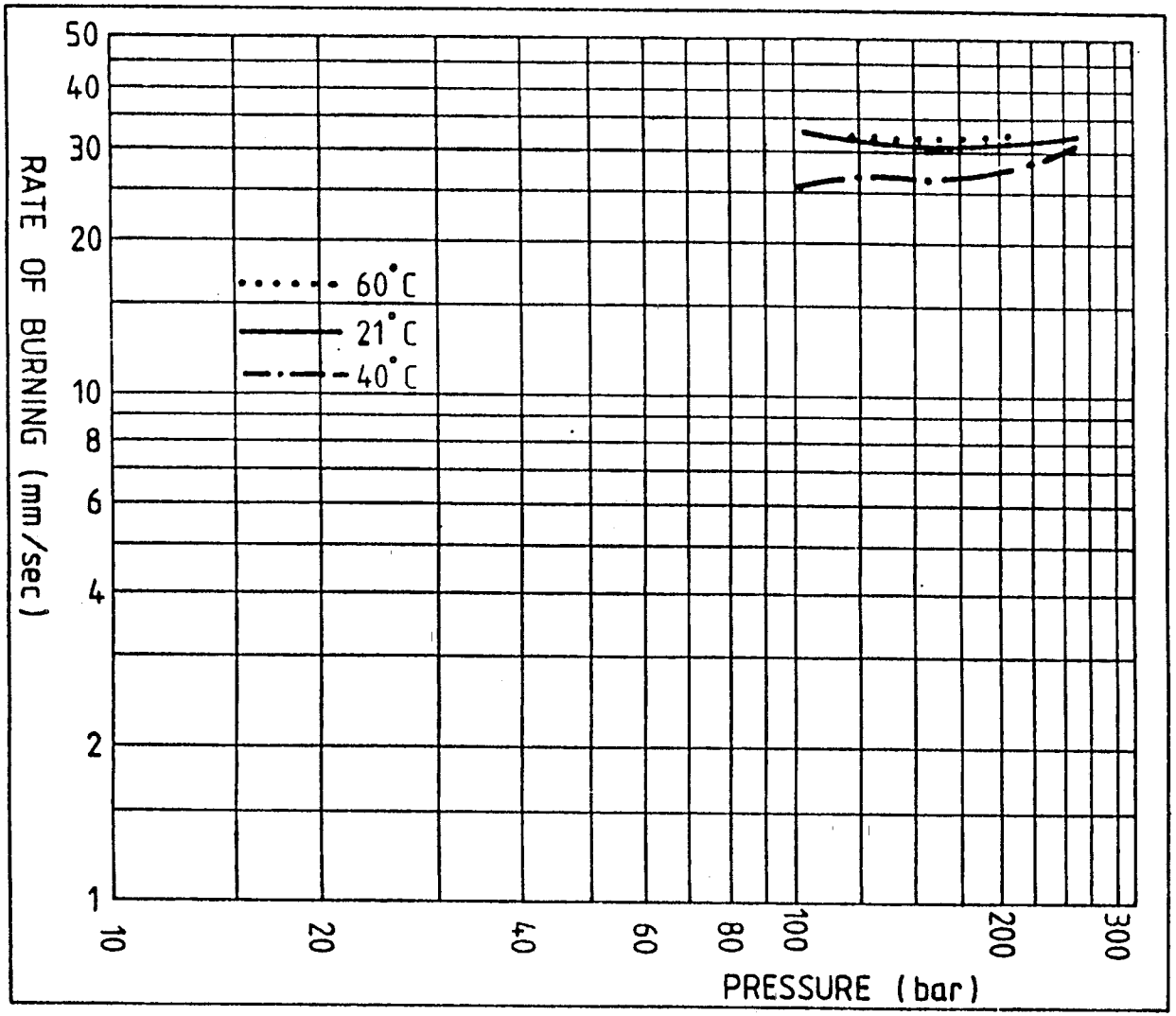

This Example was a platonised high energy cast double base propellant containing 0.5% of copper II caproate and 1.0% of lead β-resorcylate as ballistic modifier and 36.6% of RDX as energetic filler. The ballistic test results of this composition shown in FIG. 5 indicate that plateau burning at about 30 mm/sec. with satisfactory temperature coefficient occurs over the pressure range of about 130–250 bar.

EXAMPLE 6

Figure 6:
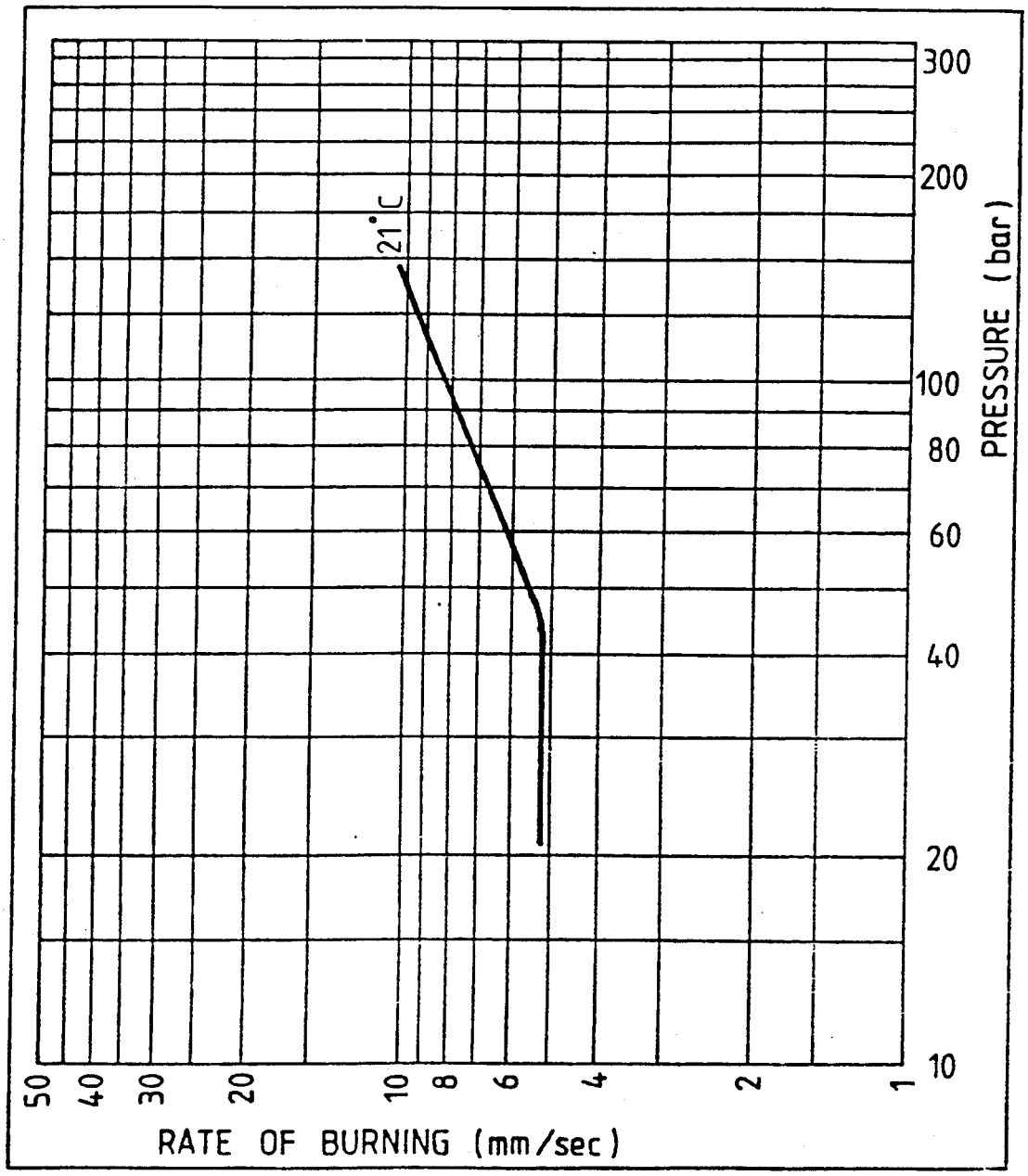

This Example was a platonised elastomer-modified solvent-processed extruded propellant composition containing 2.5% of copper II caproate as ballistic modifier and 3.0% of polycaprolactone (isocyanate crosslinked) as polymeric binder crosslinking the nitrocellulose. The ballistic test results of this composition shown in FIG. 6 indicate that plateau burning at the slow rate of about 5 mm/sec occurs over the pressure range of about 20–40 bar.

EXAMPLE 7

Figure 7:
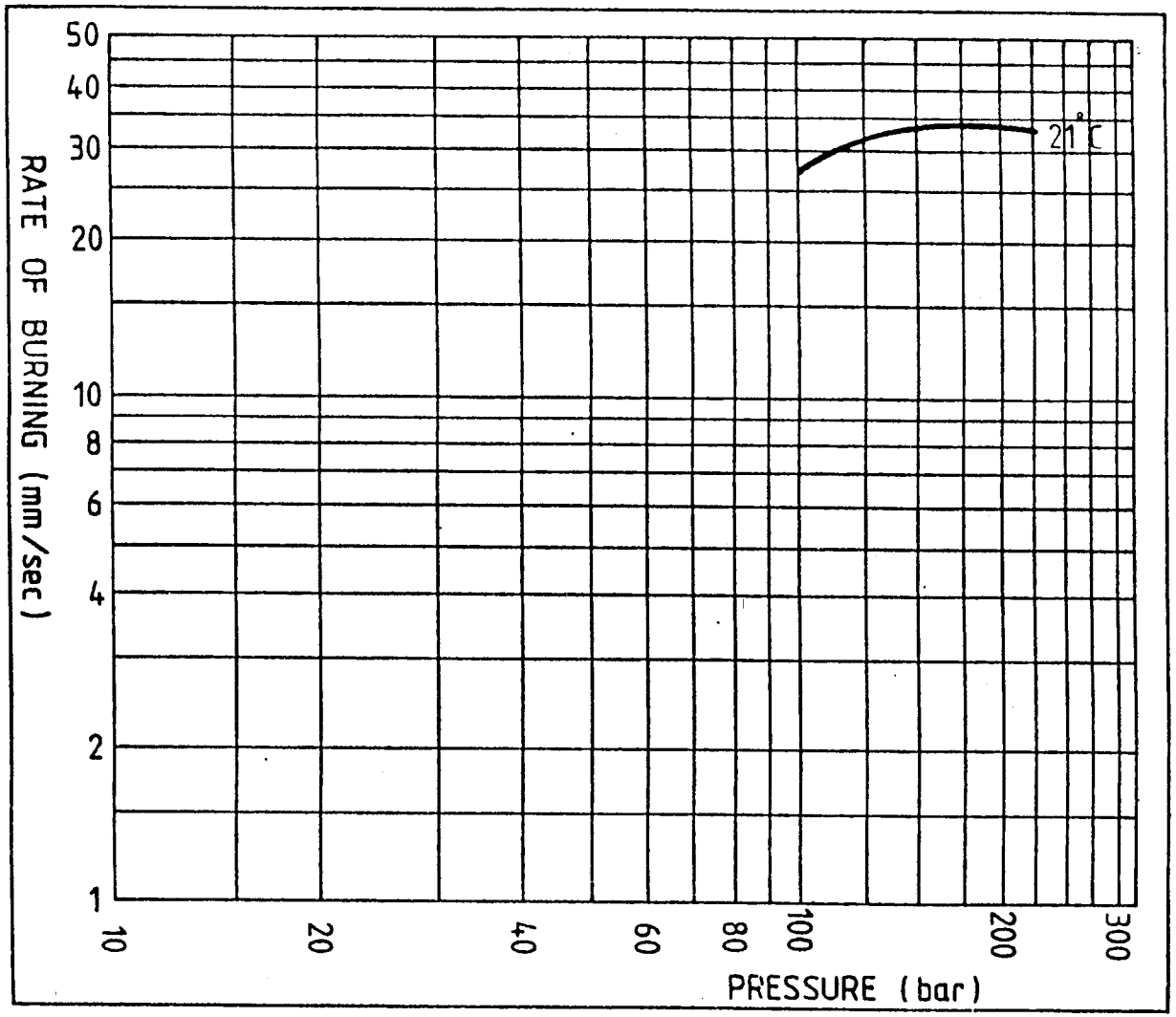

This Example was a platonised solvent processed extruded double base propellant composition containing 2.0% of copper II octanoate and 4.0% of lead β-resorcylate as ballistic modifier. The ballistic test results of this composition shown in FIG. 7, indicate that plateau burning at about 34 mm/sec. occurs over the pressure range of about 130–250 bar.

EXAMPLE 8

Figure 8:
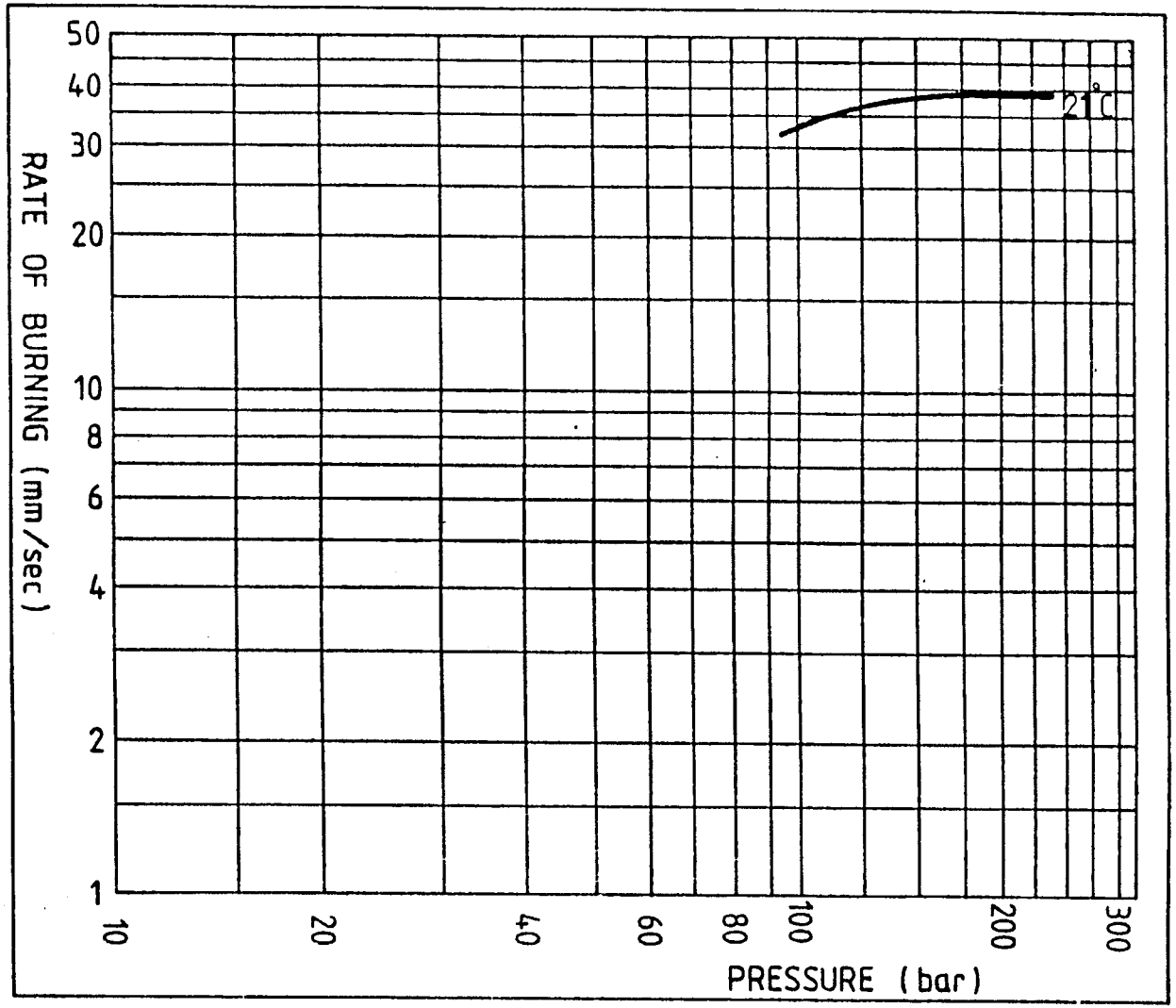

This Example was a platonised, solvent-processed, extruded double base propellant composition containing 2.0% of copper II decanoate and 4.0% of lead β-resorcylate as ballistic modifier. The ballistic test results of this composition shown in FIG. 8, indicate that plateau burning occurs at about 38 mm/sec. over the pressure range of about 150–250 bar.

EXAMPLE 9

Figure 9:
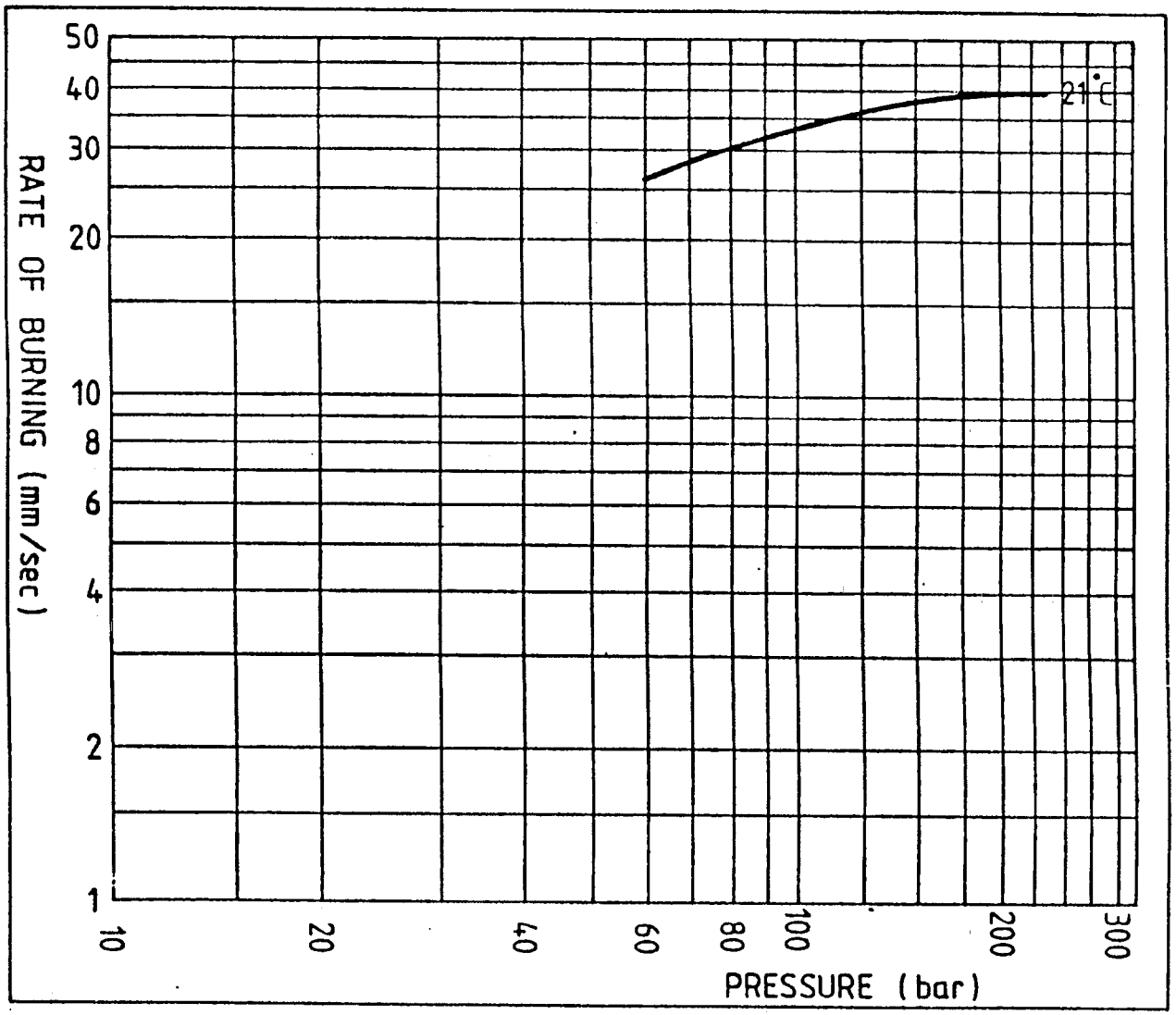

This Example was a platonised solvent-processed extruded double base propellant composition containing 2.0% of copper 2-ethyl hexanoate and 4.2% of lead β-resorcylate as ballistic modifier. The ballistic test results of the composition, shown in FIG. 9 indicate that plateau burning occurs at about 40 mm/sec over the pressure range of about 180–250 bar.

TABLE 1

| | PROPELLANT COMPOSITIONS | | | | | | | | |
|---|---|---|---|---|---|---|---|---|---|
| | EXAMPLE | | | | | | | | |
| COMPOSITION (PARTS) | 1 | 2 | 3 | 4 | 5 | 6 | 7 | 8 | 9 |
| NC (12.6% N) | 36.4 | | 40.8 | 36.4 | 17.3 | 28.6 | 36.1 | 36.1 | 37.2 |
| NC (12.2% N) | | 48.1 | | | | | | | |
| NC | 48.9 | 43.3 | 38.1 | 44.3 | 34.9 | 53.6 | 48.3 | 48.3 | 47.3 |
| Para nitro-N-methylaniline | 0.6 | | 0.7 | 0.6 | 0.7 | 0.7 | 0.6 | 0.6 | 0.6 |
| 2-Nitrodiphenylamine | 0.3 | 2.0 | 0.3 | 0.3 | 0.3 | 0.3 | 0.5 | 0.5 | 0.4 |
| Resorcinol | 0.6 | — | — | 0.6 | 0.6 | — | 0.6 | 0.6 | 0.6 |
| Tracetin | 5.8 | — | 10.9 | 5.8 | 5.8 | 9.2 | 6.7 | 6.7 | 6.4 |
| Lead β-resorcylate | 4.1 | 3.0 | — | 4.1 | 1.0 | — | 4.0 | 4.0 | 4.2 |
| Copper II caproate | 2.0 | 2.0 | 1.7 | 2.0 | 0.5 | 2.5 | — | — | — |
| Carbon black | 1.2 | 0.6 | — | 1.2 | 0.3 | 0.22 | 1.2 | 1.2 | 1.3 |
| Sucrose octoacetate | — | — | 5.8 | — | — | — | — | — | — |
| Lead acetophthalate | — | — | 1.7 | — | — | 2.5 | — | — | — |
| Aluminium | — | — | — | 4.6 | — | — | — | — | — |
| RDX | — | — | — | — | 38.6 | — | — | — | — |
| Polycaprolactone (isocyanate cross-linker) | — | — | — | — | — | 3.0 | — | — | — |
| Dibutylphthalate | — | 1.0 | — | — | — | — | — | — | — |
| Candelilla Wax | — | 0.08 | — | — | — | — | — | — | — |
| Copper Octanoate | — | — | — | — | — | — | 2.0 | — | — |
| Copper Decanoate | — | — | — | — | — | — | — | 2.0 | — |
| Copper 2-ethyl hexanoate | — | — | — | — | — | — | — | — | 2.0 |
| Preparation Method | Cast | Solventless extruded | Cast | Cast | Cast | Solvent extruded | Solvent extruded | Solvent extruded | Solvent extruded |
| Platonised burning rate mm/sec | 45 | 36 | 5.0–3.5 (mesa) | 40 | 30 | 5 | 34 | 38 | 39 |
| Platonised pressure range (bar) | 175–300 | 180–250 | 30–45 | 150–300 | 130–250 | 20–40 | 130–250 | 150–250 | 175–225 |
| Energy (calories/gm) (apprpx.) | 1026 | 1079 | 831 | 1126 | 1188 | 1002 | 1024 | 1022 | 1024 |

What is claimed is:

1. In a nitrocellulose based propellent composition containing a platonizing ballistic modifier, the improvement comprising, as a platonizing ballistic modifier, a copper II complex of a $C_6$–$C_{12}$ straight chain aliphatic monocarboylic acid, said complex being effective to introduce a region of distinct operational platonization in the burning rate versus pressure relationship of the propellent composition, when used as the sole ballistic modifier, and to modify said relationship in favor of enhanced operational platonization when present as a supplementary ballistic modifier.

2. A propellant composition as claimed in claim 1 wherein the ballistic modifier includes at least one lead compound that is effective as a ballistic modifier and said complex is selected from the group consisting of copper II complexes of caproic acid, caprylic acid, capric acid, and lauric acid.

3. A propellant composition as claimed in claim 1, containing from 3 to 6.5% by weight of ballistic modifier.

4. A propellant composition as claimed in claim 3, containing 1.7 to 5.0% by weight of the copper II complex of a $C_6$ to $C_{12}$ chain aliphatic monocarboxylic acid.

5. A propellant composition as claimed in claim 1, comprising at least one ingredient selected from the group consisting of stabilizers, plasticizers, burning rate moderants, lubricants and flash suppressants.

6. A propellant composition as claimed in claim 5, comprising at least one member selected from the group consisting of paranitro N-methylaniline, 2-nitrodiphenylamine, resorcinol, sucrose octoacetate, triacetin, dibutylphthalate, carbon black, candelilla wax, polycaprolactone cross-linked with isocyanate, and potassium nitrate.

7. A propellant composition as claimed in claim 1, comprising an energetic constituent selected from the group consisting of nitramines and metal powders.

8. A propellant composition as claimed in claim 7, comprising cyclo-1,3,5-trimethylene 2,4,6-trinitramine.

9. The propellant composition of claim 1 which also includes as a ballistic modifier a compound selected from the group consisting of lead stearate, lead citrate, lead phthalate, lead acetophthalate, lead salicylate, lead-β-resorylate, basic copper salicylate, copper β-resorcylate and copper oxide,

* * * * *